US006459011B1

(12) United States Patent
Tarr et al.

(10) Patent No.: US 6,459,011 B1
(45) Date of Patent: Oct. 1, 2002

(54) DIRECTED POLLUTANT OXIDATION USING SIMULTANEOUS CATALYTIC METAL CHELATION AND ORGANIC POLLUTANT COMPLEXATION

(75) Inventors: Matthew A. Tarr, Metairie, LA (US); Michele E. Lindsey, Lawrence, KS (US)

(73) Assignee: University of New Orleans Research and Technology Foundation, Inc., New Orleans, LA (US)

( * ) Notice: Subject to any disclaimer, the term of this patent is extended or adjusted under 35 U.S.C. 154(b) by 0 days.

(21) Appl. No.: 09/596,675

(22) Filed: Jun. 19, 2000

Related U.S. Application Data

(60) Provisional application No. 60/139,979, filed on Jun. 18, 1999.

(51) Int. Cl.[7] ..... A62D 3/00

(52) U.S. Cl. ..... 588/205; 588/200; 588/207; 405/128.5; 405/128.75

(58) Field of Search ..... 588/200, 205, 588/206, 207; 210/747, 758, 763, 681, 682, 684, 687, 688; 405/128.5, 128.75

(56) References Cited

U.S. PATENT DOCUMENTS 4,726,905 A * 2/1988 Friedman et al. ..... 134/7
5,190,663 A * 3/1993 Fetzer ..... 210/674
5,370,798 A * 12/1994 Uchiyama et al. ..... 210/681
5,425,881 A * 6/1995 Szejtli et al. ..... 210/747
5,741,427 A * 4/1998 Watts et al. ..... 210/747
6,160,194 A * 12/2000 Pignatello ..... 210/759
6,232,518 B1 * 5/2001 Ou ..... 210/702

* cited by examiner

*Primary Examiner*—Stanley S. Silverman
*Assistant Examiner*—Eileen E. Nave
(74) *Attorney, Agent, or Firm*—Garvey, Smith, Nehrbass & Doody, L.L.C.; Seth M. Nehrbass

(57) ABSTRACT

A method of oxidizing organic pollutants in a solution comprises chelating a catalytic metal with cyclodextrins (CD) and/or derivatized cyclodextrins (dCD), and simultaneously complexing an organic pollutant with cyclodextrins (CD) and/or derivatized cyclodextrins (dCD). The CD or dCD is capable of removing the pollutant from sorption sites (either in solution, in soil/sediment, or on surfaces). Furthermore, the CD/dCD is also capable of competing with other metal chelators that may be present in the system. The ability of the CD/dCD to bind both the pollutant and the metal in the presence of competing binding sites is essential for the success of the technique.

40 Claims, No Drawings

DIRECTED POLLUTANT OXIDATION USING SIMULTANEOUS CATALYTIC METAL CHELATION AND ORGANIC POLLUTANT COMPLEXATION

CROSS-REFERENCE TO RELATED APPLICATIONS

Priority of U.S. Provisional Patent Application Serial No. 60/139,979, filed Jun. 18, 1999, incorporated herein by reference, is hereby claimed.

STATEMENT REGARDING FEDERALLY SPONSORED RESEARCH OR DEVELOPMENT

A portion of the work on this invention has been funded by the Office of Naval Research, ONR contract number N000149911098. The government may have rights in this invention.

REFERENCE TO A "MICROFICHE APPENDIX"

Not applicable

BACKGROUND OF THE INVENTION

1. Field of the Invention

The present invention relates to pollution abatement. More particularly, the present invention relates to abatement of organic pollutants.

2. General Background of the Invention

BRIEF DESCRIPTION OF PRESENTLY USED TECHNOLOGY AND ITS DISADVANTAGES.

A wide range of technologies is currently available for degradation of pollutants, including chemical and biological techniques. Many of these methods, however, are limited by the presence of non-pollutant compounds (matrix). The matrix can sequester the pollutant away from biologically or chemically active sites. Furthermore, the matrix can scavenge reactive transients in chemical systems, thereby lowering degradation efficiency. Biological systems are often limited by toxic effects, especially when high pollutant concentrations or mixtures are present.

The use of iron(II) and hydrogen peroxide alone is severely limited by matrix species through: 1) sequestration of pollutants away from the bulk aqueous phase, 2) chelation of iron(II) into sites that are physically separate (on a molecular scale) from the location of pollutants, and 3) scavenging of hydroxyl radical by matrix compounds.

Current methods for soil washing involve the use of surfactants or cyclodextrins. These methods exhibit some success in washing organic pollutants from soils or aqueous solutions, but they do not degrade the pollutant. Additional further treatment of the waste is still necessary after its removal from the contaminated site. The second treatment step adds additional costs, makes these methods more complicated, and limits their applicability to in situ remediation.

The following U.S. Patents are incorporated herein by reference: U.S. Pat. Nos.: 6,046,375; 5,967,230; 5,919,982; 5,755,977; 5,741,427; 5,520,483; 5,716,528; 5,585,515; 5,425,881; and 5,190,663.

U.S. Pat. No. 5,425,881 discloses a method for the extraction of an organic pollutant from contaminated soil without further contaminating the soil with organic solvents comprising the step of mixing aqueous solutions of cyclodextrins, or cyclodextrin derivatives selected from the group consisting of alkyl, hydroxyalkyl and acyl substituted cyclodextrin derivatives or cross-linked cyclodextrin polymers or cross-linked cyclodextrin derivatives selected from the group consisting of alkyl, hydroxyalkyl and acyl substituted cyclodextrin derivatives, with the contaminated soil.

U.S. Pat. No. 5,190,663 discloses a process for removing dissolved polynuclear aromatic hydrocarbons from an aqueous composition which comprises the step of contacting said composition with a water insoluble inclusion agent comprising an anchored cyclodextrin, said cyclodextrin having an inclusion cavity diameter of at least about 10 angstroms, wherein the concentration of dissolved organics in said aqueous composition is no greater than about fifteen percent by weight.

U.S. Pat. No. 5,741,427 describes the use of Fenton's reagent for soil remediation. This patent utilizes iron complexing agents to limit the reactivity of $H_2O_2$ with iron to allow more substantial subsurface penetration of the reagents before they are consumed. However, the patent does not utilize simultaneous binding of iron and the pollutant, and it does not indicate the use of cyclodextrins.

Commercial applications of Fenton chemistry to remediation of contaminated soil are currently in use. These methods add both iron and peroxide to the saturated zone, and utilize iron chelators and peroxide stabilizers (Greenberg et al., 1997; Watts and Dilly, 1996). Such applications have been successful in remediating the saturated zone after petroleum leakage from an underground storage tank. However, conditions for such remediation have typically been developed from empirical observations of degradation efficiency rather than from a fundamental understanding of the HO. dynamics. Furthermore, a large excess of peroxide is often used. Indeed, Jerome et al. (1997, 1998) concluded that excess peroxide was one of two top cost items in their remediation process at the Savannah River Site, and they concluded that the proportionate peroxide costs would increase with increasing scale of the problem.

In situ remediation techniques based on the use of Fenton's reaction (EPA, 1996; EPA, 2000; Geo-cleanse, 2000) have been found to be inefficient in many soils owing to the high reactivity of the reagents with soil constituents (Jerome et al., 1997; Li et al., 1998; Wang and Brusseau, 1998; Lindsey and Tarr, 2000).

The following references are incorporated herein by reference:

EPA, National Center for Environmental Research, http://es.epa.gov/ncerqa_abstracts/centers/hsrc/detection/det9.html, 1996.

EPA, Urban Watershed Management Branch, http://www.epa.gov/ednnrmrl/projects/urban/fenton.htm Geo-Cleanse, Inc., www.geocleanse.com, 2000.

Jerome, K. M., B. Riha, and B. B. Looney, "Final Report for Demonstration of In Situ Oxidation of DNAPL Using the Geo-Cleanse Technology," WSRC-TR-97-00283, Westinghouse Savannah River Company, 1997.

Li, Z. M., P. J. Shea, and S. D. Comfort, "Nitrotoluene destruction by UV-catalyzed Fenton oxidation," Chemosphere 36 (8) 1849–1865, 1998.

Wang, X. and M. L. Brusseau, "Effect of pyrophosphate on the dechlorination of tetrachloroethene by the Fenton reaction," Env. Toxicol. Chem. 17 1689–1694, 1998.

Lindsey, M. E. and M. A. Tarr, "Inhibition of Hydroxyl Radical Reaction with Aromatics by Dissolved Organic Matter," Environ. Sci. Technol. 34, 444–449, 2000.

Greenberg, R. S., T. Andrews, P. K. C. Karala, and R. J. Watts, "In-Situ Fenton-Like Oxidation of Volatile Organics: Laboratory, Pilot and Full-Scale Demonstrations." Presented at *Emerging Technologies in Hazardous Waste Management IX.* Pittsburgh, Pa., 1997.

Watts, R. J., and S. E. Dilly, "Evaluation of iron catalysts for the Fenton-like remediation of diesel-contaminated soils," J. Haz. Mat. 51, 209–224, 1996.

Jerome, K. M., B. B. Looney, and B. Riha, "Field Demonstration in Situ Fenton's Destruction of DNAPLs," WSRC-RP-98-0001 1, Westinghouse Savannah River Company, 1998.

Watts, R. J., M. D Udell, P. A. Rauch, S. W. Leung, "Treatment of Pentachlorophenol-Contaminated Soils Using Fenton's Reagent," Haz. Waste Haz. Mat. 7(4), 335–345, 1990.

Watts, R. J., S. Kong, M. Dippre, W. T. Barnes, "Oxidation of Sorbed Hexachlorobenzene in Soils Using Catalyzed Hydrogen Peroxide," J. Haz. Mat. 39 33–47, 1994.

Lipczynska-Kochany, E., G. Sprah, S. Harms, "Influence of Some Groundwater and Surface Waters Constituents on the Degradation of 4-chlorophenol by the Fenton Reaction," Chemosphere 30, 9–20, 1995.

Gau, S. H., F. S. Chang, "Improved Fenton Method to Remove Recalcitrant Organics in Landfill Leachate," Water Sci. Tech., 34, 455–462, 1996.

Kim, Y. K., I. R. Huh, "Enhancing Biological Treatability of Landfill Leachate by Chemical Oxidation," Environ. Eng. Sci. 14(1), 73–79, 1997.

Walling, C. "Fenton's Reagent Revisited," Acc. Chem. Res. 8, 125–131, 1975.

Haber, F., J. Weiss, "The Catalytic Decomposition of Hydrogen Peroxide by Iron Salts," Proc. Roy. Soc. A 147, 334–351, 1934.

Halliwell, B., J. M. C. Gutteridge, "Formation of Thiobarbituric-acid-reactive Substance from Deoxyribose in the Presence of Iron Salts: The Role of Superoxide and Hydroxyl Radicals," FEBS Letters, 128, 347–352, 1981.

Sutton, H. C., C. C. Winterboum, "Chelated Iron-catalyzed OH Formation from Paraquat Radicals and $H_2O_2$: Mechanism of Formate Oxidation," Arch. Biochem. Biophys. 235,106–115, 1984.

Graf, E., J. R. Mahoney, R. G. Bryant, J. W. Eaton, "Iron-catalyzed Hydroxyl Radical Formation.

Stringent Requirement for Free Iron Coordination Site," J. Biol. Chem. 259(6),3620–3624,1984.

Lindsey, M. E. and M. A. Tarr, "Inhibited Hydroxyl Radical Degradation of Aromatic Hydrocarbons in the Presence of Dissolved Fulvic Acid," Wat. Res. 34, 2385–2389, 2000.

Lindsey, M. E. and M. A. Tarr, Quantitation of Hydroxyl Radical During Fenton Oxidation Following a Single Addition of Iron And Peroxide," Chemosphere 41, 409–417, 2000.

BRIEF SUMMARY OF THE INVENTION

The present invention is a method of oxidizing organic pollutants in a solution comprising chelating a catalytic metal with cyclodextrins (CD) and/or derivatized cyclodextrins (dCD), simultaneously complexing an organic pollutant with cyclodextrins (CD) and/or derivatized cyclodextrins (dCD). Preferably, hydrogen peroxide is added to the aqueous solution. Preferably, the metal catalyst is iron(II).

The use of the method of the present invention is anticipated to extend the range of applicability of Fenton remediation to a broader set of contaminants and soil systems than are currently possible. Furthermore, by improving the selectivity of the process for contaminants, the cost of raw materials will be decreased, providing more cost-effective remediation than currently available technologies. The successful implementation of this new technology would result in the following benefits:

- A single method capable of removing hydrophobic pollutants from sorption sites in soil or sediment while at the same time degrading the pollutant in situ. Ultimately, the technique may be capable of complete in situ destruction of persistent, bioaccumulative, and toxic (PBT) pollutants with no residual waste material that would require additional treatment or disposal.
- Cost-effective treatment and removal of PCBs, PAHs, DDT, and other PBT chemicals from contaminated sediments or soils.
- An in-situ technology that mobilizes contaminants to make them more amenable to simultaneous or subsequent in situ or ex situ treatment.

In addition to hydrogen peroxide, sodium peroxide, calcium peroxide, or mixtures thereof may be applicable as reagents.

With respect to subsurface treatment, the three reagents, CD/dCD, iron salts, and peroxide(s) (hydrogen peroxide, sodium peroxide, calcium peroxide, or mixtures thereof) can be premixed and introduced into the subsurface or can be injected sequentially, simultaneously, or any combination thereof. The reagents may be introduced to the subsurface by any method considered conventional in the art. For example, vertical wells, horizontal wells, trenches or other techniques may be used. High pressure injection may be used, and current techniques of the art may be utilized to aid in delivery of the reagents to contaminated regions of the subsurface. Multiple applications of the reagents may be applied.

Determination of the optimum reagent mixture for subsurface application can be determined by performing tests on subsurface samples from the contaminated site. Samples collected from the site can be treated in the laboratory in sealed glass vessels to optimize the amount of each reagent and to determine the optimal order for adding reagents. Such studies may include optimization of the following parameters: 1) choice and amount of iron salt, 2) iron/cyclodextrin ratio, 3) pollutant/cyclodextrin ratio, 4) peroxide dose (of hydrogen peroxide, sodium peroxide, calcium peroxide, or mixtures thereof), 5) cyclodextrin type, 6) pre-equilibration of cyclodextrin-pollutant complex, 7) soil/water ratio, and 8) pH. Determination of pollutant concentrations before, during, and after treatment can be accomplished using appropriate EPA and/or NIST methods. Soil characterization may also be conducted, including analyses for iron content, pH, particle size, clay content, bulk density, and other relevant measurements.

DETAILED DESCRIPTION OF THE INVENTION

Brief Description of the Invention and its Advantages.

Cyclodextrins (CD) or derivatized cyclodextrins (dCD) are used to simultaneously complex a metal catalyst (e.g. $Fe^{2+}$) and an organic pollutant in aqueous solution. Upon addition of hydrogen peroxide, hydroxyl radical is formed in close proximity to the pollutant, increasing the likelihood that the radical will react with the pollutant. The method is especially useful for degrading hydrophobic organic compounds in the presence of other non-pollutant chemicals (either dissolved or solid) which would otherwise interfere with pollutant degradation. Complexing the pollutant with CD or dCD removes the pollutant from microenvironments that inhibit degradation. Chelation of the catalytic metal by CD or dCD results in formation of hydroxyl radical at the microenvironmental site of the pollutant, thereby enhancing the efficiency of degradation. Iron(II) is a good choice of metal catalyst due to its low toxicity and environmentally benign nature. However, other metal catalysts (such as copper, cobalt, manganese, or nickel) could also be used. Cyclodextrins are natural products, have low toxicity, are environmentally benign, and are biodegradable. Three types of CD may be used (α-CD, β-CD, γ-CD) depending on the size of the pollutant. Derivatized cyclodextrins may be used to improve metal chelation. Carboxymethyl cyclodextrins and carboxypropyl cyclodextrins are examples of dCDs, although other derivatives are also applicable.

The inventors have found that cyclodextrin concentrations in the sample, after addition of all reagents, in the 1–5 millimolar range are effective. Iron concentrations in the sample, after addition of all reagents, in the 1–100 millimolar were effective. The inventors have worked with pollutants in the micromolar range, but there is no reason higher concentrations cannot be degraded. Hydrogen peroxide (2–50 millimolar) was added continuously at 0.15–1.5 mL/h.

The provisional patent application indicates CD concentrations in the 1–5 mM range are effective. In additional work, the inventors have found optimal cyclodextrin concentrations as high as 40 mM for some systems. Even higher concentrations maybe appropriate in some cases. Also indicated in the provisional patent application is that iron concentrations in the 1–5 mM range were effective. Additional investigations have shown optimal iron concentrations as high as 65 mM for some systems. Higher iron concentrations may be useful in some cases. In work on degradation of polychlorinated biphenyls (PCBs) sorbed to glass, the inventors have found that a slight to moderate excess of iron (with respect to CD) is optimal. For example, iron-CD ratios of about 3–1 to about 10–1 have been optimal.

The original work of the inventors involved continuous addition of hydrogen peroxide solution to the pollutant solution. More recent work has involved a single addition of peroxide solution to the pollutant system. In this work, the inventors sorbed a PCB to glass, then added water (pH=3), carboxymethyl-β-cyclodextrin, then $Fe^{2+}$, then $H_2O_2$. In many cases, the inventors used low energy sonication after the addition of cyclodextrin but before addition of peroxide, to speed equilibration of this system. The inventors do not believe this step is necessary, but it is time saving. For PCBs sorbed to glass, equilibration has been observed to be complete within about 5 minutes with sonication, while without sonication, several hours may be required. For the PCB studies, the inventors have added $H_2O_2$ to yield an initial concentration of 0.2 M. As stated elsewhere, the particular concentrations of Fe, CD, and $H_2O_2$ are highly dependent on the system.

Possible Areas of Commercial Application of the Invention.

This technique will be applicable to remediation of organic pollutants in soil, sediment, groundwater, and surface water. In situ applications will be possible. The method will also be useful for degradation of organic compounds in chemical waste streams. Petroleum compounds, agricultural chemicals, dioxins, polychlorinated biphenyls (PCBs), polycyclic aromatic hydrocarbons (PAHs), textile dyes, and a wide range of other organic compounds can be treated by this method. The technique can be used alone, or can be used in conjunction with other chemical or biological degradation technologies, such as for example permanganate oxidation, natural attenuation, or inoculation with bacterial cultures.

Below is a tentative summary of procedure based on preliminary laboratory studies. More extensive studies are desirable in order to optimize the procedure. Furthermore, different optimum conditions are likely to be encountered for different systems. Additional studies will also be desirable to adapt the procedure to in situ applications.

Summary of Procedure

1) A solution, suspension, slurry, soil, or solid (the sample) is obtained which contains a hydrophobic organic pollutant and one or more of the following: dissolved organic matter, dissolved inorganic matter, sand, soil, sediment, or other particulates.
2) To the sample, a dissolved cyclic oligosaccharide is added. Examples of cyclic oligosaccharides are: α-cyclodextrin, β-cylcoldextrin, γ-cyclodextrin, or the carboxymethyl derivatives of these cyclodextrins. To date, the most effective concentration of the cyclic oligosaccharide has been in the 1–5 millimolar range.
3) The pH of the sample may be adjusted to provide an acidic solution (pH<6). Although this step may be beneficial, some studies indicate it is not essential.
4) Dissolved iron (II) perchlorate is added to the sample. To date, the most effective concentration of iron has been in the 1–5 millimolar range. (For certain applications, it maybe appropriate to add dissolved Fe(II) perchlorate. However, other forms of iron or other metals may be used including, but not limited to, ferrous perchlorate, ferric perchlorate, ferrous sulfate, ferric sulfate, ferrous ammonium sulfate, ferric chloride, ferric nitrate, ferrous nitrate, iron oxyhydroxides, manganese oxyhydroxides and combinations thereof. Note that the use of Fe(III) and iron oxyhydroxides may be acceptable, although the inventors have not yet demonstrated this. For some systems, sufficient soluble iron or other metals may be present so that no additional catalyst is required. For example, soils with high $Fe^{2+}$content may not require addition of iron. Again, this is an issue that needs to be addressed in studies of field application of the technique.)
5) With continuous stirring, dissolved hydrogen peroxide is added continuously to the sample. For samples of around 5 mL, 2–50 millimolar solutions of hydrogen peroxide have been added at flow rates of 0.15–1.5 mL/h. (Hydrogen peroxide may be added either continuously or as a single addition.)
6) In general, the concentration of cyclodextrin, iron, and the flow rate and concentration of hydrogen peroxide are dependent on the sample volume, pollutant identity and concentration, and matrix identity and concentration.

The above example discusses the sample as, "A solution, suspension, slurry, soil, or solid . . . " However, the technique will be most advantageous as an in situ method of remediating polluted soil and groundwater. As such, the reagents would be injected into the subsurface. In future work, the inventors may be developing methods of introducing these reagents to the subsurface.

Addition of dCD to aqueous solutions has been shown to enhance the degradation rate of polycyclic aromatic hydrocarbons. Table 1 indicates the initial rate of pyrene degradation as a function of carboxymethyl-β-cyclodextrin concentration. The rate of pyrene degradation was increased by as much as 26% with added dCD. Furthermore, when dissolved natural organic (NOM) matter was present, the degradation of pyrene was inhibited. This inhibition is believed to occur do to binding of iron in hydrophilic sites and binding of pyrene in hydrophobic sites of the NOM. It is hypothesized that these binding sites are spatially separate on a molecular scale, resulting in removal of the pollutant from the formation site of hydroxyl radical. Addition of dCD, however, restored the rate of pyrene degradation to that in pure water. Presumably, the dCD was able to preferentially bind both iron and the pollutant so that the two were held in close proximity. Under these conditions, it is likely that hydroxyl radical-pollutant reaction became more probable.

Further evidence that the ternary complex (pollutant-iron-dCD) forms and is able to direct hydroxyl radical attack on the pollutant is given in Table 2. Addition of chloride to the aqueous system resulted in lower degradation rate of the pollutant due to scavenging of hydroxyl radical by chloride. When dCD was present, addition of chloride did not affect the degradation rate. The theoretical explanation for this effect is that when the ternary complex is present, hydroxyl radical is formed in close proximity to the pollutant, and pollutant-hydroxyl radical reaction is favored over reaction of hydroxyl radical with a bulk aqueous scavenger, such as chloride.

Table 3 illustrates the ability of dCD to improve the degradation efficiency of a pollutant sorbed to a surface. Carboxymethyl-β-cyclodextrin dramatically improved the degradation efficiency of 2,2',6,6'-tetrachlorobiphenyl sorbed to glass with a single addition of hydrogen peroxide in the presence of dissolved $Fe^{2+}$. It is believed that the dCD is able to both solubilize the pollutant and form a ternary complex with iron, resulting in formation of hydroxyl radical at the site of the pollutant, yielding more efficient degradation.

TABLE 1

Initial rate of pyrene degradation as a function of added dCD.

| Concentration of carboxymethyl-β-cyclodextrin (mM) | Initial Rate ($M\ s^{-1}$) |
|---|---|
| 0 | 7.7 ± 0.1 |
| 0.1 | 8.0 ± 0.2 |
| 0.2 | 8.2 ± 0.2 |
| 0.3 | 9.3 ± 0.09 |
| 0.4 | 9.1 ± 0.08 |
| 0.5 | 9.7 |
| 0 + 20 mg $L^{-1}$ HA | 6.2 ± 0.1 |
| 0.4 + 20 mg $L^{-1}$ HA† | 7.5 ± 0.3 |

†HA = Suwannee River humic acid

TABLE 2

Normalized initial rate as a function of chloride concentration with and without carboxymethyl-β-cyclodextrin.

| [$Cl^-$] (mM) | $R/R_O$† | $R/R_O$ with added carboxymethyl-β-cyclodextrin (0.4 mM) |
|---|---|---|
| 3.2 | 1.00 ± 0.06 | 1.00 ± 0.04 |
| 4.2 | — | 0.92 ± 0.05 |
| 6.2 | 0.65 ± 0.05 | 0.93 ± 0.08 |
| 8.2 | 0.48 ± 0.05 | 0.98 ± 0.05 |
| 10.2 | 0.43 ± 0.06 | — |
| 13.2 | 0.46 ± 0.06 | 0.91 ± 0.08 |

†$R/R_O$ = initial rate divided by initial rate at 3.2 mM $Cl^-$.

TABLE 3

Extent of degradation PCB sorbed to glass as a function of carboxymethyl-β-cyclodextrin concentration.

| [carboxymethyl-β-cyclodextrin] (mM) | % Degradation 2,2',6,6'-tetrachlorobiphenyl |
|---|---|
| 0 | 35 ± 4 |
| 2.5 | 47 ± 3 |
| 5 | 63 ± 2 |
| 7.5 | 65 ± 2 |
| 10 | 64 ± 2 |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

What is claimed is:

1. A method of oxidizing organic pollutants in a sample comprising a solution, suspension, slurry, soil, or solid comprising:

chelating a catalytic metal in said sample with cyclodextrins (CD) and/or derivatized cyclodextrins (dCD);

simultaneously complexing an organic pollutant in said sample with cyclodextrins (CD) and/or derivatized cyclodextrins (dCD).

2. The method of claim 1, further comprising adding hydrogen peroxide, sodium peroxide, calcium peroxide, or mixtures thereof to the solution, suspension, slurry, soil, or solid.

3. The method of claim 1, wherein the organic pollutant is a hydrophobic organic compound which is in the presence of other non-pollutant chemicals which would otherwise interfere with pollutant degradation.

4. The method of claim 1, wherein the catalytic metal is iron(II).

5. The method of claim 1, wherein the cyclodextrins include α-CD.

6. The method of claim 1, wherein the cyclodextrins include β-CD.

7. The method of claim 1, wherein the cyclodextrins include γ-CD.

8. The method of claim 1, wherein the derivatized cyclodextrins include carboxymethyl cyclodextrin.

9. The method of claim 1, wherein the derivatized cyclodextrins include carboxypropyl cyclodextrin.

10. The method of claim 1, wherein the organic pollutant is selected from the group consisting of petroleum compounds, agricultural chemicals, dioxins, polychlorinated biphenyls (PCBs), polycyclic aromatic hydrocarbons (PAHs), textile dyes, and other hydrophobic organic compounds.

11. The method of claim 1, further comprising using other chemical or biological degradation technologies.

12. The method of claim 1, wherein the sample is an aqueous solution.

13. The method of claim 1, wherein the sample is a chemical waste stream.

14. The method of claim 1, wherein the sample is a slurry.

15. The method of claim 1, wherein the sample is a solid.

16. The method of claim 1, wherein the derivatized cyclodextrins include α-dCD, β-dCD, and/or γ-dCD.

17. The method of claim 1, wherein the sample is soil, sand, sediment, groundwater, or any subsurface region.

18. The method of claim 1, wherein the catalytic metal, cyclodextrins (CD) and/or derivatized cyclodextrins (dCD) are injected subsurface.

19. The method of claim 1, wherein PCBs, or other organic pollutants, sorbed to a surface are degraded.

20. The method of claim 19, wherein the surface is glass.

21. The method of claim 19, wherein the surface is metal.

22. The method of claim 19, wherein the surface is a polymer or composite.

23. The method of claim 19, wherein the surface includes significant amounts of grime.

24. The method of claim 19, comprising decontaminating organic chemical warfare agents from vehicles.

25. The method of claim 1, wherein the cyclodextrins (CD) and/or derivatized cyclodextrins (dCD) bind both the organic pollutant and the catalytic metal in the presence of competing binding sites.

26. The method of claim 1, wherein the pH of the sample is adjusted to provide an acidic solution (pH<6).

27. The method of claim 1, wherein the catalytic metal is added to the sample.

28. The method of claim 1, wherein the cyclodextrins (CD) and/or derivatized cyclodextrins (dCD) are added to the sample in an initial concentration of about 1–10 millimoles of CD and/or dCD per liter of total sample volume, including all other added reagents.

29. The method of claim 1, wherein the catalytic metal is added to the sample in an initial concentration of about 10–1000 millimoles of catalytic metal per liter of aqueous solution added to the sample.

30. The method of claim 1, wherein the catalytic metal is added to the sample to provide an initial concentration of about 10–100 millimoles of catalytic metal per liter of total sample volume, including all other added reagents.

31. The method of claim 1, wherein hydrogen peroxide, sodium peroxide, calcium peroxide, or mixtures thereof are added to the solution, suspension, slurry, soil, or solid in an initial concentration of about 0.1–1 millimoles of hydrogen peroxide, sodium peroxide, calcium peroxide, or mixtures thereof per liter of sample, including all other added reagents.

32. The method of claim 1, wherein the cyclodextrins (CD) and/or derivatized cyclodextrins (dCD) are added to the sample in an initial concentration of about 0.1–50,000 moles of CD and/or dCD per mole pollutant.

33. The method of claim 1, wherein the cyclodextrins (CD) and/or derivatized cyclodextrins (dCD) are added to the sample in an initial concentration of about 1–10,000 moles of CD and/or dCD per mole pollutant.

34. The method of claim 1, wherein the cyclodextrins (CD) and/or derivatized cyclodextrins (dCD) are added to the sample in an initial concentration of about 5–5000 moles of CD and/or dCD per mole pollutant.

35. The method of claim 1, wherein iron is added to the sample in an initial concentration of about 0.1–100 moles Fe per mole CD and/or dCD.

36. The method of claim 1, wherein iron is added to the sample in an initial concentration of about 0.5–50 moles Fe per mole CD and/or dCD.

37. The method of claim 1, wherein iron is added to the sample in an initial concentration of about 1–10 moles Fe per mole CD and/or dCD.

38. The method of claim 1, wherein hydrogen peroxide, sodium peroxide, calcium peroxide, or mixtures thereof is added to the sample in an initial concentration of about 0.1–500 moles peroxide/mole iron.

39. The method of claim 1, wherein hydrogen peroxide, sodium peroxide, calcium peroxide, or mixtures thereof is added to the sample in an initial concentration of about 1–100 moles peroxide/mole iron.

40. The method of claim 1, wherein hydrogen peroxide, sodium peroxide, calcium peroxide, or mixtures thereof is added to the sample in an initial concentration of about 5–20 moles peroxide/mole iron.

* * * * *